United States Patent [19]

Ragland, Jr.

[11] Patent Number: 4,939,412

[45] Date of Patent: Jul. 3, 1990

[54] COLOR PICTURE TUBE HAVING IMPROVED SHADOW MASK-FRAME ASSEMBLY

[75] Inventor: Frank R. Ragland, Jr., Lancaster, Pa.

[73] Assignee: RCA Licensing Corporation, Princeton, N.J.

[21] Appl. No.: 428,447

[22] Filed: Oct. 30, 1989

Related U.S. Application Data

[63] Continuation of Ser. No. 175,895, Mar. 30, 1988, abandoned.

[51] Int. Cl.[5] ..... H01J 29/81

[52] U.S. Cl. ..... 313/407; 313/404

[58] Field of Search ..... 313/402, 404, 407

[56] References Cited

U.S. PATENT DOCUMENTS

| | | | |
|---|---|---|---|
| B 523,696 | 1/1976 | Groot | 313/404 |
| 3,529,199 | 9/1970 | Duistermaat et al. | 313/85 |
| 3,548,235 | 12/1970 | Driedijk et al. | 313/85 |
| 3,890,526 | 6/1975 | Palac | 313/408 |
| 3,894,260 | 7/1975 | Sedivy | 313/405 |
| 3,896,321 | 7/1975 | Sedivy | 313/404 |
| 3,912,564 | 10/1975 | Rogers | 156/60 |
| 3,921,024 | 11/1975 | Bakker et al. | 313/404 |
| 3,999,098 | 12/1976 | Dougherty | 313/407 |
| 4,056,755 | 11/1977 | Sohn | 313/402 |
| 4,317,064 | 2/1982 | Dougherty | 313/406 |
| 4,572,983 | 2/1986 | Ragland, Jr. | 313/405 |
| 4,599,533 | 7/1986 | Ragland, Jr. | 313/407 |
| 4,613,785 | 9/1986 | Ragland, Jr. | 313/405 |
| 4,638,211 | 1/1987 | Fonda | 313/407 X |
| 4,670,687 | 6/1987 | Gijrath et al. | 313/404 |
| 4,700,105 | 10/1987 | Ito | 313/407 |

FOREIGN PATENT DOCUMENTS 48-7673 12/1973 Japan .

*Primary Examiner*—Donald J. Yusko
*Assistant Examiner*—Michael Horabik
*Attorney, Agent, or Firm*—Joseph S. Tripoli; Dennis H. Irlbeck

[57] ABSTRACT

A rectangular color picture tube of the shadow mask type includes an improved mask-frame assembly and support therefor. The frame has two substantially perpendicular flanges, a first flange and a second flange. The first flange extends from the second flange away from the screen of the tube. The second flange extends from the first flange toward the shadow mask. The second flange includes peripherally spaced tabs extending therefrom. The shadow mask is telescoped into the frame and is attached to the tabs. In a preferred embodiment, the corners of the frame are truncated. Springs are interconnected to each truncated corner of the frame to support the mask-frame assembly within the tube.

9 Claims, 4 Drawing Sheets

COLOR PICTURE TUBE HAVING IMPROVED SHADOW MASK-FRAME ASSEMBLY

This is a continuation of Ser. No. 175,895, filed Mar. 30, 1988, now abandoned.

This invention relates to color picture tubes of the type having a shadow mask attached to a peripheral frame which is suspended in relation to a cathodoluminescent screen, and, particularly, to a novel mask-frame assembly for such tubes.

BACKGROUND OF THE INVENTION

In color picture tubes, the accuracy with which the electron beams, emitted from an electron gun, strike individual elemental cathodoluminescent screen areas, depends to a great degree upon the accuracy with which the shadow mask apertures are aligned with the elemental screen areas during operation of the tube. During initial tube operation, the shadow mask is heated by the impingement of the electron beams thereon at a much faster rate than is the heavier peripheral frame. Because of the lack of heat input to the mask periphery, the apertured portion of the shadow mask expands at a greater rate than does its periphery. The mask periphery acts as a cold band around the apertured portion and causes the apertured portion to dome. Such doming causes the electron beams, passing through the mask, to misregister with their associated elemental screen areas, thereby producing an undesirable shift in color on the screen.

In most current color picture tube types, the peripheral frame is suspended in a faceplate panel by means of springs that either are directly welded to the frame or are welded to plates which in turn are welded to the frame. In the directly welded version, the springs are made of bimetallic metals, and in the plate version, the plates are of bimetallic material. As the springs or plates become heated by transfer of heat from the mask through the frame, the bimetallic materials expand differently, thereby bending the springs or plates to cause movement of the mask-frame assembly toward the tube screen.

It is common to use either three or four springs to support a mask-frame assembly within a rectangular faceplate panel of a tube. In a three spring support system, one spring is usually located at the upper center of the mask, and the other two springs are located along the sides of the tube between the centers of the sides of the mask and the lower two corners of the mask. In a four-spring support system, springs are usually located at the top and bottom centers of the mask and at the left and right centers of the mask. In both the three- and four-spring support systems, as described above, it is possible for the mask-frame assembly to slightly twist and shift relative to the faceplate during tube operation.

There is a need to develop a tube with a mask-frame assembly and support system that will minimize the mask doming, mask twisting and shifting problems, and that also will be economical to construct. The present invention fulfills such a need.

SUMMARY OF THE INVENTION

A color picture tube of the shadow mask type includes an improved mask-frame assembly. The frame has two substantially perpendicular flanges, a first flange and a second flange. The first flange extends from the second flange away from the screen of the tube. The second flange extends from the first flange toward the shadow mask. The second flange includes peripherally spaced tabs extending therefrom. The shadow mask is attached to the tabs. In a preferred embodiment, the corners of the frame are truncated. Springs are interconnected to each truncated corner of the frame to support the mask-frame assembly within the tube.

DETAILED DESCRIPTION OF THE PREFERRED EMBODIMENT

Figure 1:
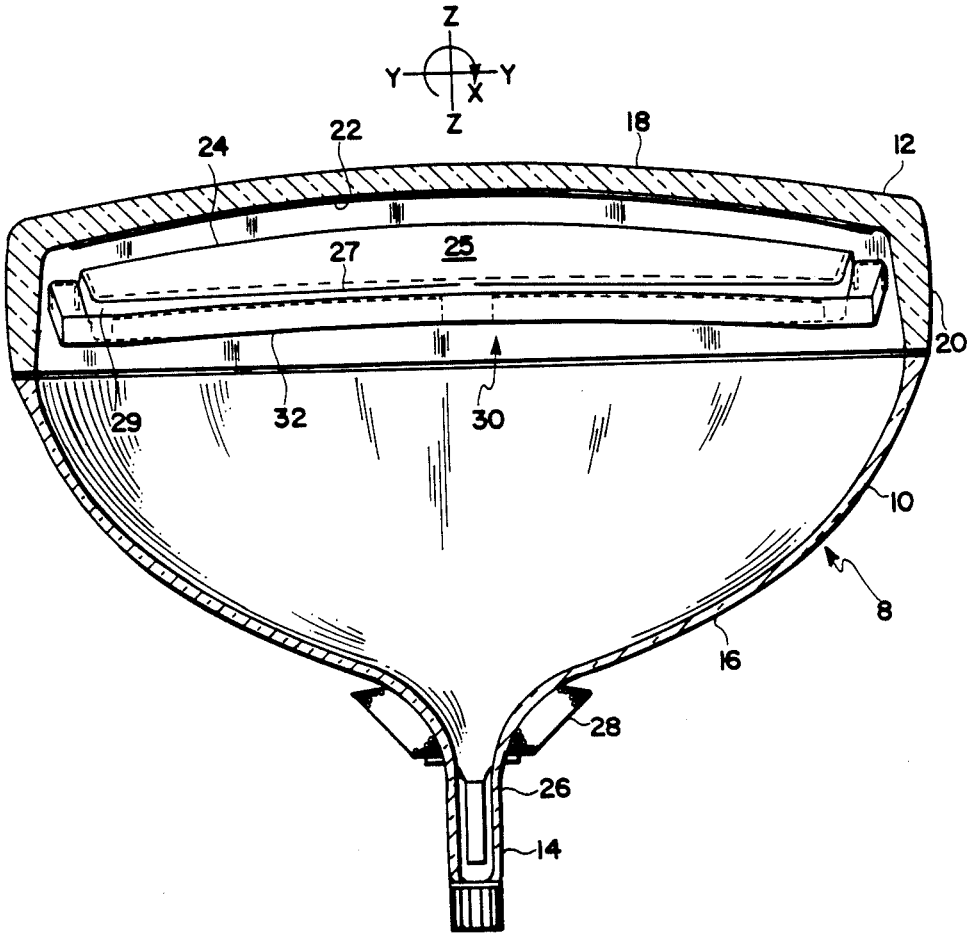
FIG. 1 is an axially sectioned side view of a color picture tube embodying the present invention.

FIG. 1 shows a rectangular color picture tube 8 having a glass envelope 10, comprising a rectangular faceplate panel 12 and a tubular neck 14 connected by a rectangular funnel 16. The panel 12 comprises a viewing faceplate 18 and peripheral flange or sidewall 20 which is sealed to the funnel 16. The faceplate panel 12 includes two orthogonal axes: a major axis X—X, parallel to its wider dimension (usually horizontal), and a minor axis Y—Y, parallel to its narrower dimension (usually vertical). The major and minor axes are perpendicular to the central longitudinal axis Z—Z of the tube which passes through the center of the neck 14 and the center of the panel 12. A mosaic three-color phosphor screen 22 is carried by the inner surface of the faceplate 18. The screen preferably is a line screen with the phosphor lines extending substantially parallel to the minor axis Y—Y. Alternatively, the screen may be a dot screen. A multiapertured color selection electrode or shadow mask 24 is removably mounted, by novel means, in predetermined spaced relation to the screen 22. An electron gun 26 is centrally mounted within the neck 14, to generate and direct three electron beams along convergent paths through the mask 24 to the screen 22.

The tube of FIG. 1 is designed to be used with an external magnetic deflection yoke, such as the yoke 28 in the neighborhood of the funnel-to-neck junction. When activated, the yoke 28 subjects the three beams to magnetic fields which cause the beams to scan horizontally and vertically in a rectangular raster over the screen 22.

Figure 5:
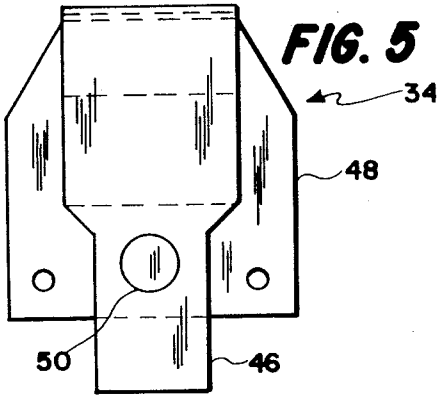
FIG. 5 is a front view of the support assembly of FIG. 4.
Figure 4:
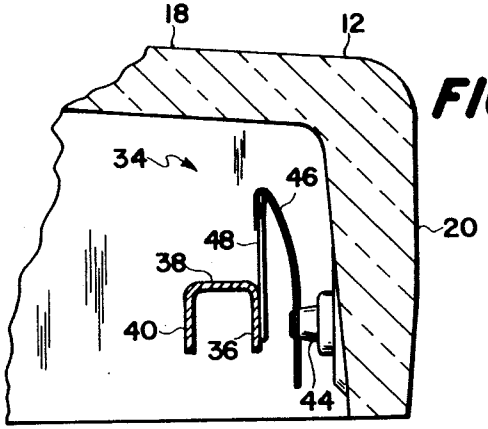
FIG. 4 is a sectional view of a corner of the faceplate panel and frame of the tube of FIG. 1, also showing a support assembly.
Figure 9:
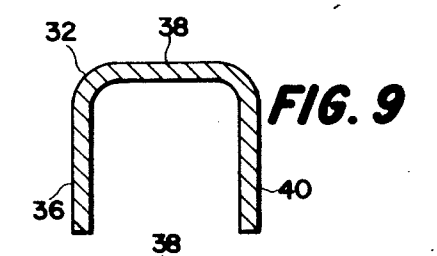
FIG. 9 is a cross-sectional view of the frame taken at line 9—9 of FIG. 6.
Figure 10:
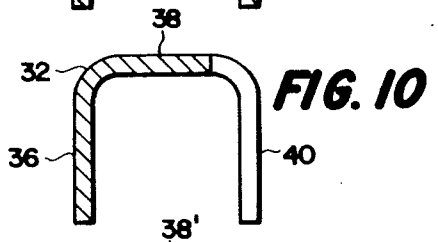
FIG. 10 is a cross-sectional view of the frame taken at line 10—10 of FIG. 6.
Figure 7:
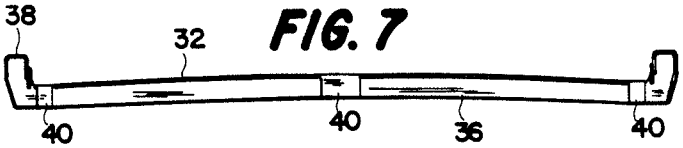
FIG. 7 is a sectional view of the frame taken at line 7—7 of FIG. 6.
Figure 6:
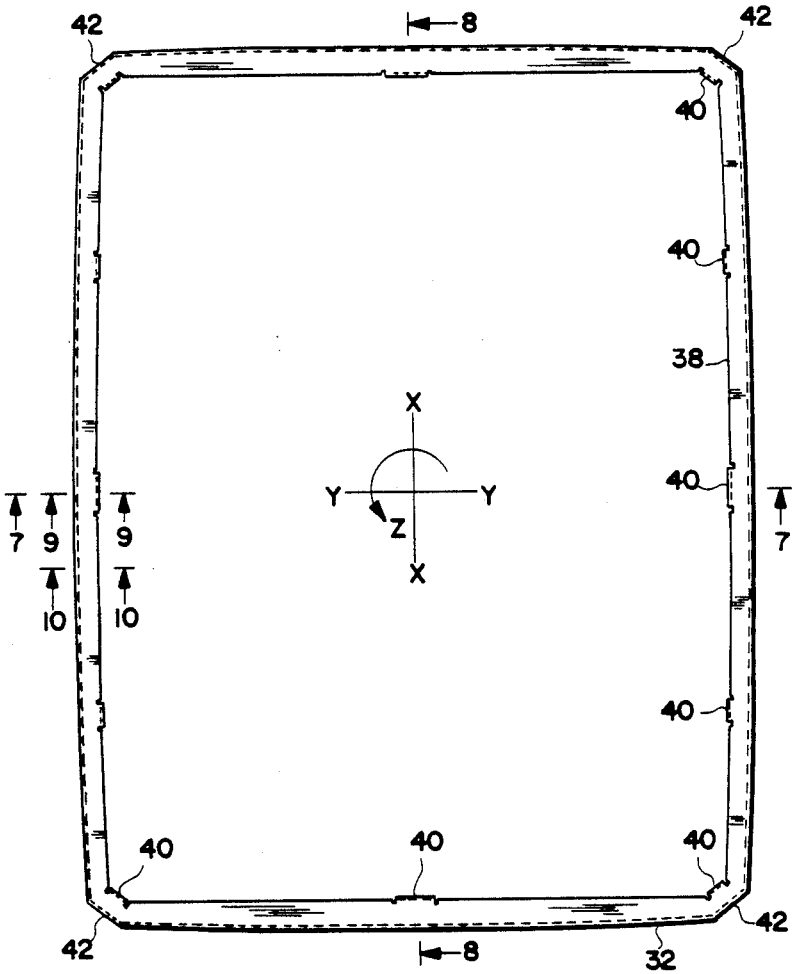
FIG. 6 is a front view of the frame of the tube of FIG. 1.
Figure 8:
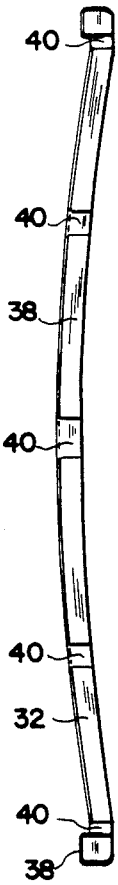
FIG. 8 is a sectional view of the frame taken at line 8—8 of FIG. 6.

The shadow mask 24 is part of a novel mask-frame assembly 30 that also includes a peripheral frame 32. The mask-frame assembly 30 is shown positioned within the faceplate panel 12 in FIGS. 1, 2 and 3. The mask-frame assembly 30 is mounted to the panel 12 by support means 34 shown in FIGS. 3, 4 and 5. The frame 32 is shown by itself in three different views in FIGS. 6, 7 and 8 and in cross-sections in FIGS. 9 and 10.

The frame 32 includes two substantially perpendicular flanges, a first flange 36 and a second flange 38, in an L-shaped cross-sectional configuration. The first flange 36 extends from the second flange 38 in a direction away from the screen 22. The second flange 38 extends from the first flange 36 in a direction toward the mask 24 and central longitudinal axis Z—Z of the tube 8. The distal edge of the second flange 38 includes a plurality of tabs 40 that are peripherally spaced from each other and extend away from the screen 22. The four corners 42 of the frame 32 are truncated, being angled approximately perpendicular to the diagonal directions of the frame.

The mask-frame assembly support means 34 includes a support assembly in each of the four corners of the frame and panel. Each support assembly includes a stud 44, a spring 46 and a bimetallic plate 48. Each stud 44 is a hollow conical-shaped metal member that is imbedded in the sidewall 20. Each bimetallic plate 48 is welded to the flange 36 at a truncated corner 42 of the frame 32 so that it extends toward the faceplate 18 with its lower expansion side facing a stud. Each spring 46 is bent back to about 22° at one end after it is welded to the bimetallic plate 48. An aperture 50, near the free end of each spring 46, engages the conical tip of a stud 44.

Figure 2:
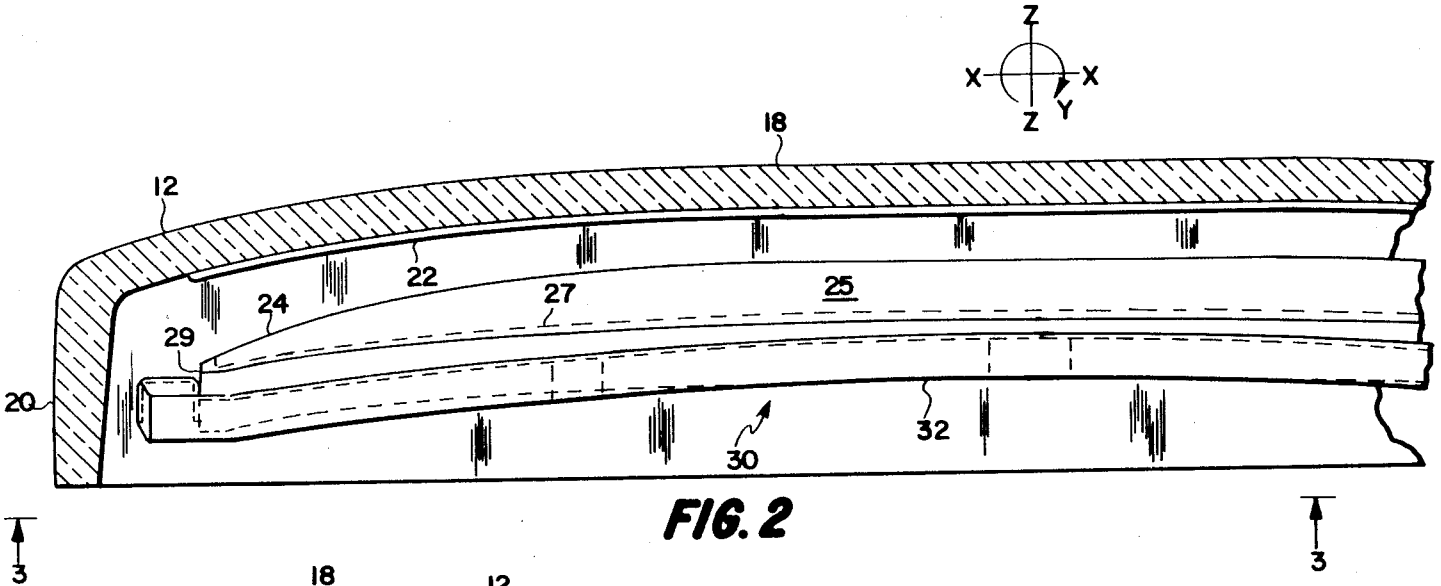
FIG. 2 is a partial axially sectioned top view of the faceplate panel and mask-frame assembly of the tube of FIG. 1.
Figure 3:
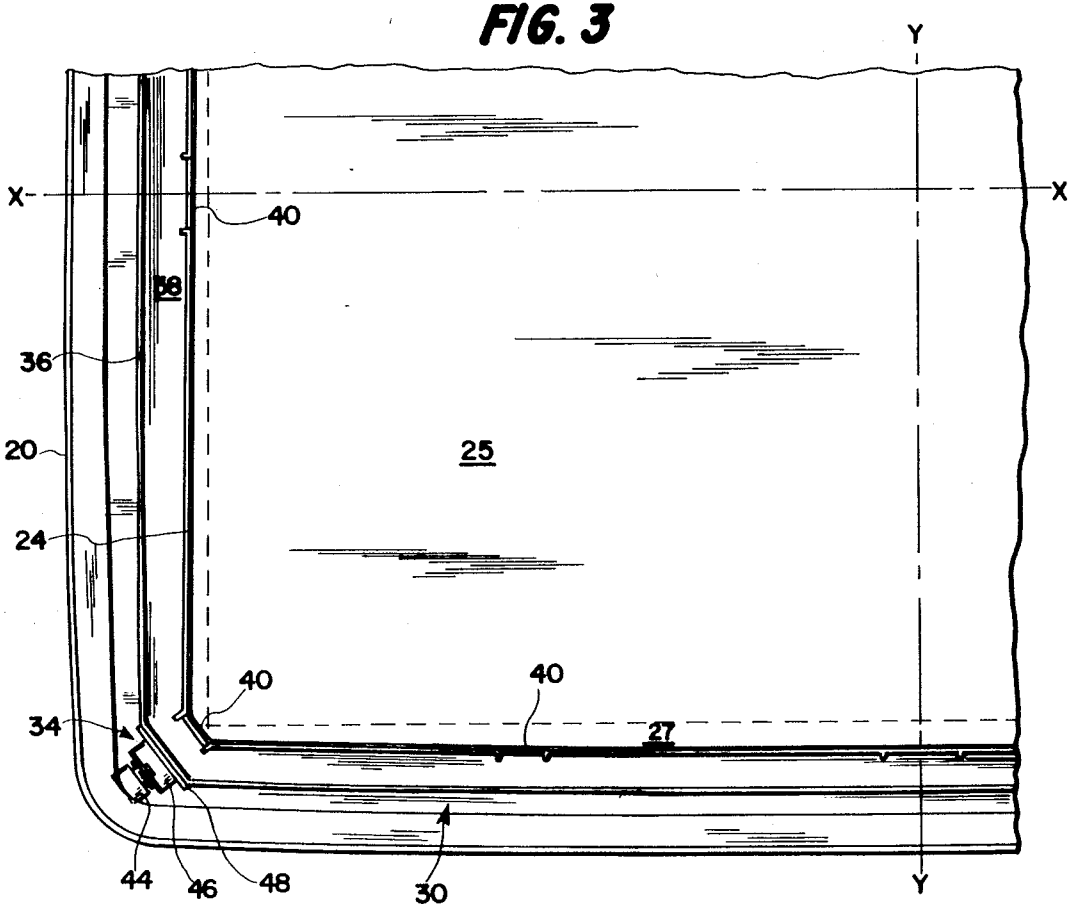
FIG. 3 is a partial bottom view of the faceplate panel and mask-frame assembly taken at line 3—3 of FIG. 2.

The shadow mask 24, as shown in FIGS. 1, 2 and 3, includes a curved apertured portion 25; an imperforate border portion 27, surrounding the apertured portion 25; and a skirt portion 29, bent back from the border portion 27 and extending away from the screen 22. The mask 24 is telescoped within or set inside the frame 32 and contacts the frame 32 only at the tabs 40. The skirt portion 29 of the mask is welded directly to eight of the twelve tabs 40. These eight tabs are located at the four corners and at the major and minor axes. The other four tabs serve as vibration suppressors. The number of tabs used for support and vibration suppression may vary in other embodiments.

Figure 11:
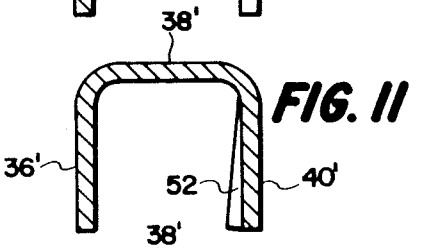
FIG. 11 is a cross-sectional view of an alternative frame corresponding to the view of FIG. 9.
Figure 12:
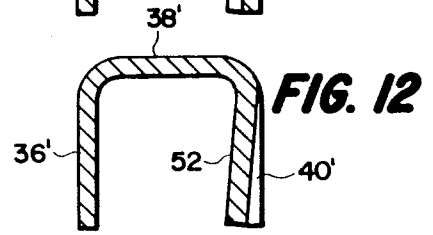
FIG. 12 is a cross-sectional view of the alternative frame corresponding to the view of FIG. 10.

Although the frame 32 has been shown with separated tabs 40 extending from the distal edge of the second flange 38, integral tabs 40' also may be part of a third flange 52 that extends from the distal edge of a second flange 38', as shown in FIGS. 11 and 12. In this additional embodiment, a frame 32 has a U-shaped cross-section around its periphery. FIG. 11 represents a cross-section of the frame 32' corresponding to the same location as the cross-section of FIG. 9. FIG. 12 represents a cross-section of the frame 32' corresponding to the same location as the cross-section of FIG. 10. The frame 32' includes a first flange 36' connected to the second flange 38' in the same manner as the first flange 36 is connected to the second flange 38 in the frame 32. The third flange 52 extends from the second flange 38' at an angle less than 90° except for the portions of the flange 38' that form the tabs 40'. The tabs 40' are formed by embossments in the third flange 52 so that they extend perpendicularly from the second flange 38'.

Unlike most prior masks, the mask 24 has a very narrow border portion 27. As little as about 3% electron beam overscan provides sufficient electron beam energy to heat the portion 27. The combination of reduced border size and limited contact with the frame 32 provides a reduction in the cold band around the apertured portion 25 of the mask 24, thereby reducing mask doming. Also, the limited contact of the skirt portion 29 with the tabs 40 permits some flexing of the skirt portion 29 during mask warmup, thereby further reducing mask doming. Addtionally, the support assemblies at the four corners of the frame and panel prevent twisting and shifting of the mask-frame assembly during tube operation. Furthermore, the mask-frame assembly 30, wherein the mask 24 is telescoped within or set inside the frame 32, permits faster and more accurate fabrication of the assembly, thereby providing greater economy of construction. For example, because the tabs parallel the longitudinal axis Z—Z of the tube, the mask may be inserted into the frame from either side of the frame. This permits the possibility of first mounting the frame within the faceplate panel and then inserting or telescoping the mask into the frame from its back side. When properly positioned, the mask can be welded to the tabs which are easily accessible.

I claim:

1. In a color picture tube comprising an envelope including a rectangular faceplate panel and a neck interconnected therewith, said tube also comprising a rectangular shadow mask attached to a peripheral frame mounted by support means within said panel, a cathodoluminescent screen located on an interior surface of said panel, and an electron gun positioned within said neck for forming a plurality of electron beams and directing said beams through said shadow mask to said screen, the improvement comprising said frame comprised of two substantially perpendicular flanges that are attached along their respective edges in an L-shaped cross-sectional configuraiton, a first of said flanges extending from a second of said flanges away from said faceplate, and the second of said flanges extending from the first flange inwardly toward said shadow mask, the second of said flanges including spaced tabs extending therefrom away from said faceplate, and said shadow mask being only attached to said tabs.

2. The color picture tube as defined in claim 1, wherien said support means comprises assemblies at the four corners of said faceplate panel.

3. The color picture tube as defined in claim 1, wherein the four corners of said frame are truncated.

4. The color picture tube as defined in claim 3, wherein said support means comprises assemblies attached to each of the four truncated corners of said frame.

5. The color picture tube as defined in claim 1 wherein said tabs are integral with a third flange extending from said second flange.

6. In a color picture tube comprising an envelope including a rectangular faceplate panel and a neck interconnected therewith, said tube also comprising a rectangular shadow mask attached to a peripheral frame mounted by support means within said panel, a cathodoluminescent screen located on an interior surface of said panel, and an electron gun positioned within said neck for forming a plurality of electron beams and directing said beams through said shadow mask to said screen, the improvement comprising said frame comprised of two substantially perpendicular flanges, a first flange and a second flange, said first flange extending from said second flange away from said screen, said second flange extending inwardly from said first flange toward said shadow mask, said second flange including peripherally spaced tabs that extend from said second flange away from said screen, said frame having truncated corners, said shadow mask being telescoped within said frame and attached to said frame at said tabs, and said support means including four springs each interconnected to a truncated corner of said frame.

7. The color picture tube as defined in claim 6 wherein said tabs are integral with a third flange extending from said second flange.

8. In a color picture tube comprising an envelope including a rectangular faceplate panel and a neck interconnected therewith, a longitudinal axis of said tube passing through the center of said neck and the center of said panel, said tube also comprising a rectangular shadow mask attached to a peripheral frame mounted by support means within said panel, said frame including two large sides and two short sides, a cathodoluminescent screen located on an interior surface of said panel, and an electron gun positioned within said neck for forming a plurality of electron beams and directing said beams through said shadow mask to said screen, the improvement comprising said frame comprised of two substantially perpendicular flanges that are attached along their respective edges in an L-shaped cross-sectional configuraiton, a first of said flanges extending from a second of said flanges away from said faceplate and paralleling the longitudinal axis of said tube, and the second of said flanges extending from the first flange inwardly toward said shadow mask and perpendicularly to the longitudinal axis of said tube, the second of said flanges including spaced tabs extending therefrom, said tabs extending away from said screen and paralleling the longitudinal axis of said tube, and said shadow mask being only attached to said tabs.

9. The color picture tube as defined in claim 8, wehrein said support means comprises assemblies at the four corners of said faceplate panel and wherein the four corners of said frame are acutely angled with respect to the long and short sides of said frame.

* * * * *